US005337571A

United States Patent [19]

Ducrocq et al.

[11] Patent Number: 5,337,571

[45] Date of Patent: Aug. 16, 1994

[54] PROCESS AND INSTALLATION FOR THE PRODUCTION OF OXYGEN GAS UNDER HIGH PRESSURE BY AIR DISTILLATION

[75] Inventors: Marc Ducrocq, Saint Maur, France; Shinji Tomita, Akashi, Japan

[73] Assignee: l'Air Liquide, Societe Anonyme pour l'Etude et l'Exploitation des Procedes Georges Claude, Paris, France

[21] Appl. No.: 946,759

[22] Filed: Sep. 17, 1992

[30] Foreign Application Priority Data

Sep. 18, 1991 [FR] France ..... 91 11479

[51] Int. Cl.[5] ..... F25J 3/00

[52] U.S. Cl. ..... 62/39; 62/41

[58] Field of Search ..... 62/24, 39, 40, 41

[56] References Cited

U.S. PATENT DOCUMENTS

| | | | |
|---|---|---|---|
| 3,222,878 | 12/1965 | Becker | 62/41 |
| 3,401,531 | 9/1968 | Kessler et al. | 62/41 |
| 4,372,764 | 2/1983 | Theobald | 62/41 |
| 4,375,367 | 3/1983 | Prentice | 62/40 |
| 4,962,646 | 10/1990 | Rathbone | 62/40 |
| 5,084,081 | 1/1992 | Rohde | 62/40 |
| 5,152,149 | 10/1992 | Mostello et al. | 62/40 |

FOREIGN PATENT DOCUMENTS

| | | |
|---|---|---|
| 0042676 | 12/1981 | European Pat. Off. . |
| 0136926 | 4/1985 | European Pat. Off. . |

*Primary Examiner*—Ronald C. Capossela

*Attorney, Agent, or Firm*—Curtis, Morris & Safford

[57] ABSTRACT

In this nitrogen-cycle installation, the cycle compressor provides a supply of high-pressure nitrogen which serves to heat oxygen supplied in liquid form from the reservoir of a low-pressure column and raised in pressure by a pump to the desired high production pressure. Oxygen gas may be produced at a pressure exceeding about 50 bars.

11 Claims, 1 Drawing Sheet

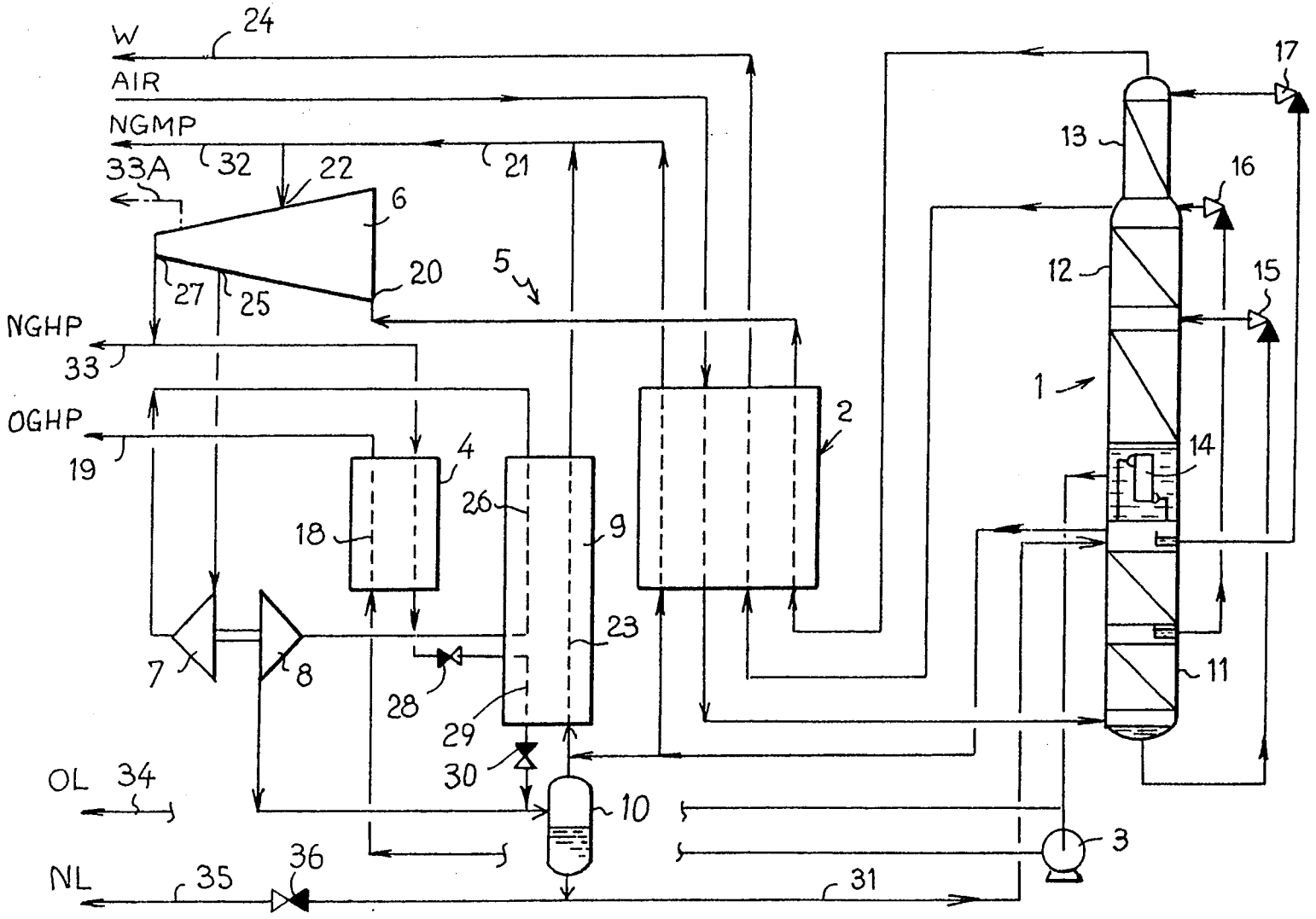
W
AIR
NGMP
33A
NGHP
33
OGHP
19
OL
34
NL
35
36
24
32
22
25
27
6
20
21
5
18
4
26
9
23
29
30
28
8
7
10
2
31
3
1
12
13
14
11
15
16
17

PROCESS AND INSTALLATION FOR THE PRODUCTION OF OXYGEN GAS UNDER HIGH PRESSURE BY AIR DISTILLATION

BACKGROUND OF THE INVENTION

This invention relates to the production of oxygen gas under high pressure by air distillation and, more particularly, to a process for producing high-pressure oxygen gas by air distillation of the type in which low temperatures are produced by a nitrogen refrigeration cycle including a stage in which nitrogen is compressed by a cycle compressor.

OBJECTS AND SUMMARY OF THE INVENTION

The object of the invention is to provide a process by which oxygen gas is produced under high pressure with relatively low capital expenditures, low energy costs and a high yield of oxygen.

In accordance with this invention, oxygen is withdrawn in liquid form from distillation apparatus and is pumped to the high production pressure. The resulting high-pressure oxygen is heated by heat exchange with nitrogen that is compressed by a cycle compressor to the heating pressure of the oxygen.

According to other characteristics of the invention:

the nitrogen is compressed by means of the cycle compressor, in part to a high cycle pressure and in part to a high oxygen heating pressure other than the cycle pressure;

the cycle compressor is also used to supply nitrogen under a high pressure that is, nevertheless, no higher than the heating pressure of the oxygen;

when air is distilled in a double distillation column of the type comprising a medium-pressure column and a low-pressure column, after heat has been exchanged with the high-pressure oxygen, the nitrogen, reduced, if necessary, to an intermediate pressure, is cooled by heat exchange with nitrogen gas withdrawn from the medium-pressure column and then is reduced to the medium pressure, with the resulting liquid nitrogen being supplied to the medium-pressure column.

Another feature of the invention is an installation designed to implement the aforedescribed process. This installation is comprised of an air distillation apparatus equipped with a heat exchange line using soldered plates and with a nitrogen refrigeration cycle including a cycle compressor; and includes a pump designed to bring liquid oxygen withdrawn from the distillation apparatus to the high production pressure and also includes exchange devices to put the high-pressure oxygen in a heat-exchange relationship with nitrogen that has been compressed by the cycle compressor to the heating pressure of the oxygen.

According to other characteristics of this installation:

the cycle compressor has a specific stage in which nitrogen is compressed to a high heating pressure of the oxygen which differs from the high pressure in the refrigeration cycle;

the cycle compressor has an outlet connected to a pipe to provide process nitrogen under a high pressure that does not exceed the above-mentioned heating pressure of the oxygen;

the heat exchange device includes an auxiliary heat exchanger separate from the heat exchange line;

when the air distillation apparatus is of the type having a double distillation column comprised of a medium-pressure column and a low-pressure column, the installation includes a countercurrent-loop heat exchanger using soldered plates and having heating passages for medium-pressure nitrogen gas, which passages are in a heat-exchange relationship with cooling passages for nitrogen at the high cycle pressure and with cooling passages for nitrogen at an intermediate pressure, the latter being located in extensions of the cooling passages for nitrogen at the high cycle pressure, with the intake of these cooling passages being connected by a pipe equipped, if necessary, with a pressure-reduction valve, to the outlet of the nitrogen passages of the heat exchange device and the outlet of the heat exchange device being connected to the medium-pressure column by means of a pipe equipped with a pressure-reduction valve;

the cycle heat exchanger is separate from the heat-exchange line and the heat exchange device.

BRIEF DESCRIPTION OF THE DRAWING

An example of the invention will now be described with reference to the attached drawing, in which the sole FIGURE is a schematic representation of an installation for the production of oxygen gas under high pressure pursuant to the invention.

DETAILED DESCRIPTION OF PREFERRED EMBODIMENT

The pressures referred to below are absolute pressure.

The installation shown in the drawing is specifically designed to produce oxygen gas under a high, supercritical pressure on the order of 85 bars. This high pressure exceeds the pressure that can normally be sustained by heat exchangers using soldered plates; that is, about 50 bars.

The installation consists essentially of an air distillation apparatus 1, a countercurrent heat-exchange line 2, a liquid-oxygen pump 3, an auxiliary heat exchanger 4, and a nitrogen-refrigeration cycle 5, which itself comprises a cycle compressor 6, a supercharger 7 coupled to an expansion turbine 8, a loop heat exchanger 9 and a phase separator 10.

The distillation apparatus 1 is of the double-column type with a relatively thin tower; that is, it consists of a medium-pressure distillation column 11, operating at about 6.8 bars, a low-pressure distillation column 12, operating at about 1.8 bars, the upper section 13 of which has a smaller diameter and forms a thin tower for the production of nitrogen gas at low pressure, and a vaporizer-condenser 14 which puts the nitrogen gas from the top of column 11 into a heat-exchange relationship with the liquid oxygen from the reservoir of column 12.

The auxiliary exchanger 4 is a countercurrent exchanger that can be of any type capable of sustaining the passage of liquids under the high pressures required for the heating of the high-pressure oxygen (for example, the type with a bank of tubes) while the loop exchanger 9 is of the type using soldered plates, adapted to sustain pressures that are less high, but considerably in excess of the medium pressure in the double column.

The air to be distilled, compressed to 6.8 bars by the air compressor (not shown) of the installation, and cleaned by any appropriate method, is cooled to the neighborhood of its dew point in the exchange line 2 and fed into the base of column 11. "Rich liquid" (air enriched with oxygen) withdrawn from the reservoir of this column is introduced, after the pressure is lowered by means of a pressure-reduction valve 15, at an intermediate level of column 12. "Inferior poor liquid" (impure nitrogen) withdrawn at an intermediate point of column 11 is introduced, after the pressure is lowered by means of a pressure-reduction valve 16, at the base of the tower 13. "Superior poor liquid" (almost pure nitrogen) withdrawn at the top of column 11 is introduced, after the pressure is lowered by means of a pressure-reduction valve 17, at the tope of the tower 13.

The apparatus 1 produces four fluids:

(a) In the reservoir of column 12, liquid oxygen which, when brought by the pump 3 to the desired high pressure, namely 85 bars, is sent to the intake, or cold end, of heating passages 18 of the exchanger 4. If this exchanger is the kind with a bank of tubes, the oxygen is introduced into the tubes. At the outlet of the exchanger 4, the high-pressure oxygen, now heated, is delivered to a utilization pipe 19.

(b) At the head of the tower 13, low-pressure nitrogen gas which, after being heated in the exchange line 2, is sent to the low-pressure suction port 20 of the cycle compressor 6.

(c) At the top of column 11, medium-pressure nitrogen gas, one portion of which is heated in the exchange line 2 and then sent via a pipe 21 to the medium-pressure suction port 22 of the compressor 6. The rest of the medium-pressure nitrogen gas is heated in passages 23 of the loop exchanger 9 and then sent into the pipe 21.

(d) At the base of the tower 13, a residual gas W (impure nitrogen) which, after being heated in the exchange Line 2, is evacuated from the installation via a pipe 24.

The compressor 6 supplies two flows of nitrogen gas:

(a) Through an intermediate discharge 25, a flow of nitrogen at the high pressure of the refrigeration cycle, on the order of 26 bars. This nitrogen is supercharged to about 35 bars by the supercharger 7, cooled in passages 26 of the exchanger 9, withdrawn from the exchanger at an intermediate point on its length, reduced to medium pressure in the turbine 8 and fed into the phase separator 10.

(b) Through a final discharge 27, a flow of nitrogen at a high, supercritical oxygen heating pressure on the order of 70 bars. This nitrogen is cooled in the auxiliary exchanger 4 (while passing through the shell of this exchanger, if it is the kind with a bank of tubes), reduced, if necessary, to an intermediate pressure, also supercritical, on the order of 50 bars by means of a pressure-reduction valve 28, cooled in the extension 29 of the cooling passages 26, reduced to medium pressure in a pressure-reduction valve 30 and fed in two-phase form into the separator 10.

The vapor leaving the separator 10 is heated in the passages 23 of the exchanger 9 at the same time as the second portion, mentioned above, of the medium-pressure nitrogen coming from column 11; then, together with this nitrogen, it enters the pipe 21. The liquid collected in the separator is sent via a pipe 31 to the top of column 11.

If desired, the installation can produce several other fluids:

medium-pressure nitrogen gas via a pipe 32 branching off the pipe 21;

nitrogen gas at the high oxygen heating pressure (70 bars) via a pipe 33 branching off the final delivery pipe of the compressor 6. Alternatively, this nitrogen gas could be produced at an intermediate pressure between this high pressure and the high cycle pressure, as indicated by the dot-dash line at 33A on the drawing;

low pressure liquid oxygen via a pipe 34 branching off the feed pipe of the pump 3:

low-pressure liquid nitrogen via a pipe 35 branching off the pipe 31 and equipped with a pressure-reduction valve 36.

The installation can be modified to supply oxygen at a wide variety of high pressures, with the oxygen-heating nitrogen being compressed by the cycle compressor 6 at a high pressure adapted to the high oxygen pressure.

What is claimed is:

1. A process for the production of high-pressure oxygen gas by distilling air in an air distillation column, wherein nitrogen withdrawn from the column is compressed and heated to an oxygen heating pressure by a cycle compressor, said process comprising the steps of withdrawing oxygen in liquid form from the distillation apparatus, pumping the withdrawn oxygen to a high production pressure, and heating the oxygen at said high production pressure in a single heat transfer stage by heat exchange only with said nitrogen compressed to said oxygen heating pressure by said cycle compressor.

2. A process according to claim 1, wherein part of the nitrogen withdrawn from the column is compressed by said cycle compressor to a high cycle pressure, and part of the nitrogen withdrawn from the column is compressed to a high oxygen heating pressure that is different from said high cycle pressure.

3. A process according to claim 1 wherein said cycle compressor supplies process nitrogen at another pressure no higher than said high oxygen heating pressure.

4. A process for the production of high-pressure oxygen gas by distilling air in an air distillation column which includes a double distillation column comprising a medium-pressure column and a low-pressure column; wherein nitrogen withdrawn from the column is compressed by a cycle compressor, said process comprising the steps of withdrawing oxygen in liquid form from the distillation apparatus, pumping the withdrawn oxygen to a high production pressure, heating the oxygen at said high production pressure by heat exchange only with said nitrogen compressed to an oxygen heating pressure by said cycle compressor, withdrawing nitrogen gas from said medium pressure column, cooling the nitrogen that has been heat-exchanged with said high production pressure oxygen by further heat exchange with said nitrogen gas withdrawn from the medium-pressure column, reducing said cooled nitrogen to said medium pressure to produce two-phase nitrogen, and feeding liquid nitrogen to said medium-pressure column.

5. A process according to claim 4, further comprising the step of reducing to an intermediate pressure, that is greater than said medium pressure, the pressure of the nitrogen gas that has cooled by heat exchange with said high production pressure oxygen before the cooled nitrogen gas is heat exchanged with said withdrawn nitrogen gas.

6. An installation for the production of high-pressure oxygen gas by air distillation having an air distillation column, a first heat exchanger incapable of withstanding a given high pressure and having a cycle compressor for compressing nitrogen withdrawn from the distillation column to an oxygen heating pressure at least equal to said given high pressure, said installation including a pump for bringing liquid oxygen withdrawn from the distillation column to a high pressure at least equal to said given high pressure, a second heat exchanger capable of withstanding said given high pressure for heat-exchanging said liquid oxygen at said high pressure with said nitrogen compressed by the cycle compressor to said oxygen heating pressure and means for coupling said liquid oxygen at said high pressure from said pump to said second heat exchanger only.

7. The installation according to claim 6 wherein the cycle compressor has a separate stage for compressing nitrogen to said oxygen heating pressure that is different from the high pressure of the refrigeration cycle.

8. The installation according to claim 7 wherein the cycle compressor includes an outlet connected to a pipe to supply nitrogen at a high pressure that does not exceed said oxygen heating pressure.

9. An installation for the production of high-pressure oxygen gas by air distillation having an air distillation column which is a double distillation column type having a medium-pressure column and a low-pressure column; a first heat exchange means incapable of withstanding a given high pressure and having a cycle compressor for compressing nitrogen withdrawn from the distillation column to an oxygen heating pressure at least equal to said given high pressure, said installation including a pump for bringing liquid oxygen withdrawn from the distillation column to a high pressure at least equal to said given high pressure, a second heat exchange means capable of withstanding said given high pressure for heat-exchanging said liquid oxygen at said high pressure with said nitrogen compressed by the cycle compressor to said oxygen heating pressure, and a third heat exchange means which is a countercurrent-loop heat exchanger having first passages for heating medium-pressure nitrogen gas, said first passages being in heat-exchange relationship with second passages for cooling nitrogen at a high cycle pressure and with third passages for cooling nitrogen at an intermediate pressure, said third passages being an extension of said second passages and having an intake coupled to an outlet of nitrogen passages included in said second heat exchange means, said third passages having an outlet coupled to the medium-pressure column via a pressure-reduction valve.

10. The installation according to claim 9 further comprising a pressure reduction valve for coupling said intake of said third passages to said outlet of nitrogen passages included in said third heat exchange means.

11. The installation according to claim 9 wherein said third heat exchange means is separate from said first and second heat exchange means.

* * * * *

UNITED STATES PATENT AND TRADEMARK OFFICE

CERTIFICATE OF CORRECTION

PATENT NO. : 5,337,571

DATED : August 16, 1994

INVENTOR(S) : Marc Ducrocq et al.

It is certified that error appears in the above-identified patent and that said Letters Patent is hereby corrected as shown below:

Claim 5, line 4, (column 4, line 58), after "has" insert --been--.

Signed and Sealed this

Eleventh Day of October, 1994

*Attest:*

*Attesting Officer*

BRUCE LEHMAN

*Commissioner of Patents and Trademarks*